United States Patent [19]

Speno

[11] 4,314,569

[45] Feb. 9, 1982

[54] BRA FOR ATHLETIC ACTIVITIES

[76] Inventor: Joanne E. Speno, 1977 Reliez Valley Rd., Lafayette, Calif. 94549

[21] Appl. No.: 60,828

[22] Filed: Jul. 25, 1979

[51] Int. Cl.[3] ..... A41C 3/00

[52] U.S. Cl. ..... 128/425; 2/275

[58] Field of Search ..... 128/425, 436, 426; 2/275

[56] References Cited

U.S. PATENT DOCUMENTS 1,843,494 2/1932 Pilatsky ..... 128/425

4,127,135 11/1978 Stern ..... 128/425

*Primary Examiner*—Doris L. Troutman

*Attorney, Agent, or Firm*—Owen, Wickersham & Erickson

[57] ABSTRACT

A bra specifically constructed for athletic activities such as jogging has top cups which extend down farther than on conventional bras, putting the seam between the top cups and the under cups below the apex to avoid irritation. Side panels at the outer ends of each under cup extend only the height of the under cup, and each top cup extends farther back accordingly, above the adjacent side panel, to a seam at the rearward edge of the top cup and side panel. All raw edges of seams on the bra are either on the outside or, if inside, are concealed from contact with the skin. The material for the top cups and under cups may be soft and non-stretchable, such as cotton. Each aspect of the bra's construction is effective to reduce irritation to the wearer during athletic activities wherein the breasts have a tendency to bounce or sway with respect to the body.

9 Claims, 8 Drawing Figures

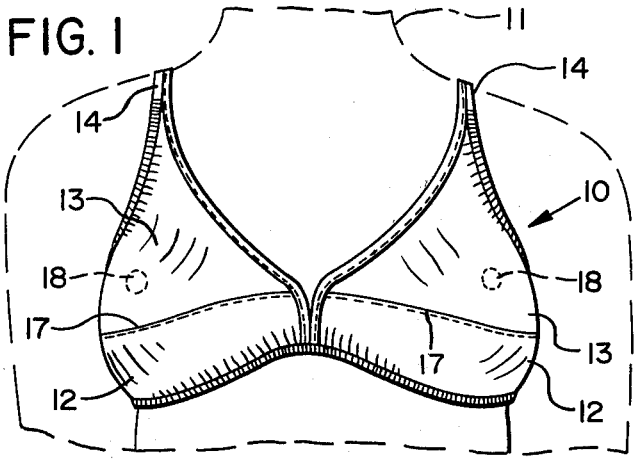
FIG. 1
11
14
14
13
10
18
18
17
17
13
12
12
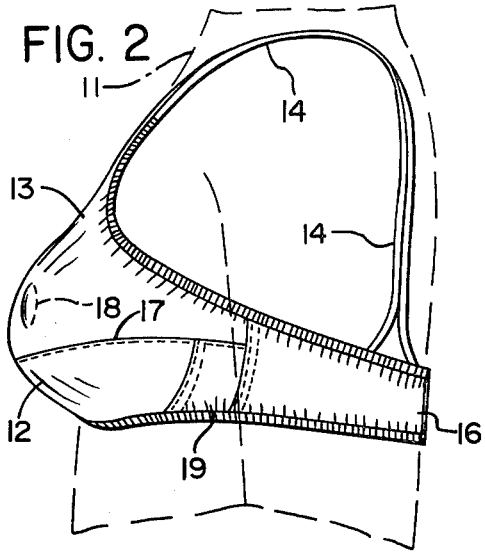
FIG. 2
11
14
13
14
18
17
12
16
19
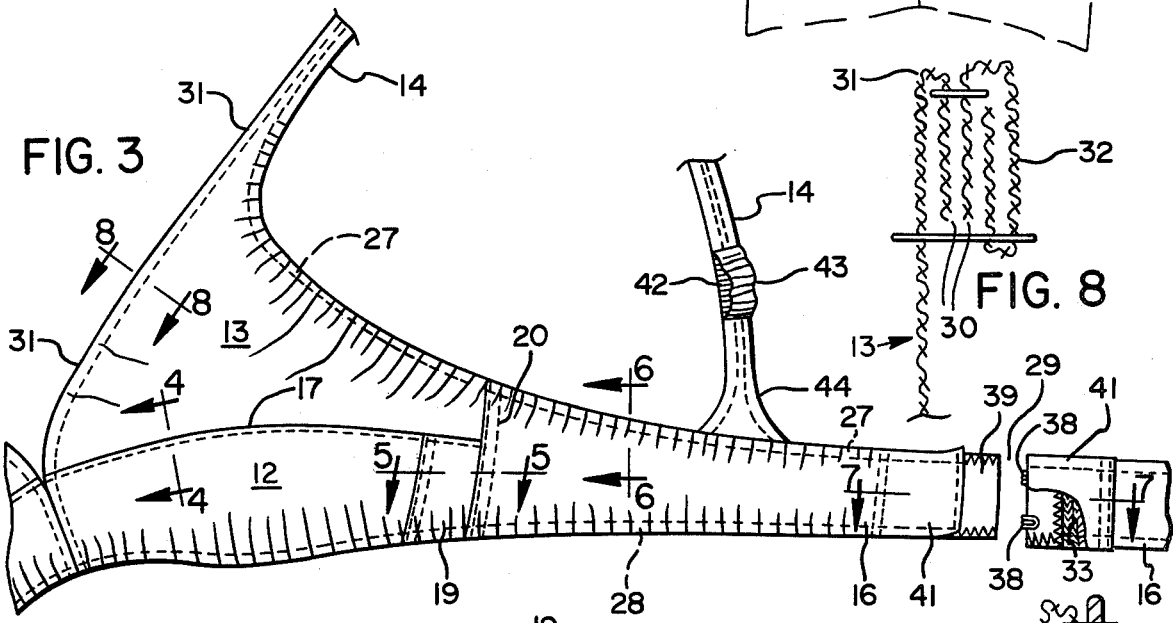
FIG. 3
31
14
8
27
8
13
31
4
17
20
6
14
42
43
44
27
39
29
38
41
12
5
5
6
7
7
4
19
28
16
41
38
33
16
FIG. 8
31
32
30
13
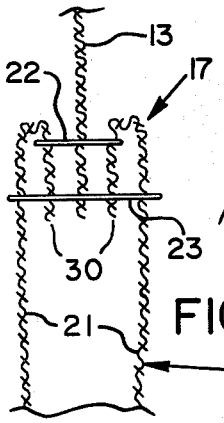
13
22
17
23
30
21
12
FIG. 4
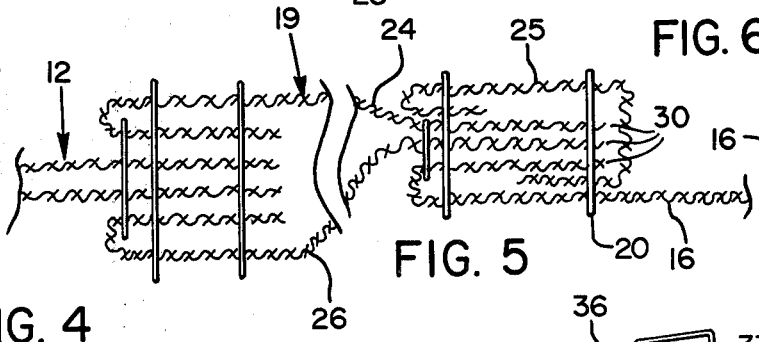
12
19
24
25
30
20
16
26
FIG. 5
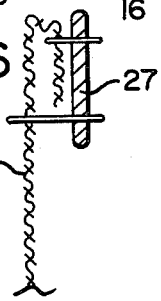
FIG. 6
27
16
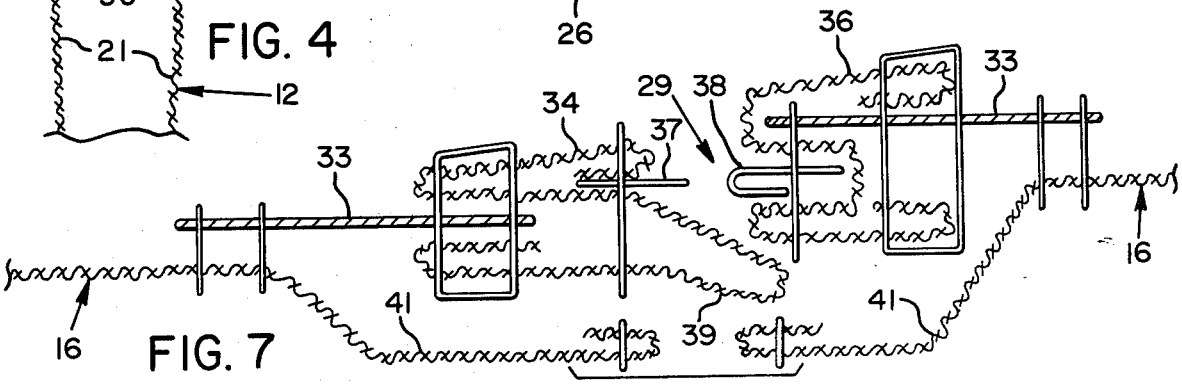
36
33
29
38
34
37
33
16
16
41
39
41
FIG. 7

BRA FOR ATHLETIC ACTIVITIES

BACKGROUND OF THE INVENTION

The invention relates to brassieres, and more particularly to an improved, non-irritating bra for sporting activities.

During sporting activities, such as jogging, tennis, gymnastics, etc., most women need the support of a bra to retain the breasts relatively immobile, avoiding uncomfortable bouncing and swaying. Conventional bras typically have a large number of seams comprising raw edges of material, particularly in critical support areas, as well as hardware for connection together and adjustment of the bra. The seams and the hardware tend to cause considerable irritation to the wearer during many sporting activities, and these bras have generally been impractical and unacceptable.

Recently several new bra constructions have been suggested and marketed particularly for jogging and other sporting activities. However, several of the sporting bras have still included a large number of seams, with raw edges in locations which can cause severe irritation problems. Some of the sporting bras simply do not provide the required support for the breasts. No previous bra has been as comfortable and as irritation-free, yet providing as adequate support, as the athletic bra of the present invention described below.

SUMMARY OF THE INVENTION

The present invention provides a bra for athletic activities having superior comfort capabilities through the elimination of seams (particularly raw edges) at irritating locations and through a new top cup and under cup construction. The bra construction assures adequate support for the breasts, preventing bounce and sway during jogging and other sporting activities involving similar movements, although the construction of the bra is quite simple.

According to the present bra construction each of the top cups extends, toward the body's side, beyond the under cup, to a seam which also forms the rearward side of a side panel below the top cup. The side panel extends only to the bottom of the top cup. Also the top cup extends lower than is typical of conventional bras, below the nipple or apex of the breasts by a sufficient distance to avoid irritation to the nipple by the seam between the top cup and the under cup below. The separate side panels are reinforced to support and contour the under cups, in lieu of an underwire.

The raw edges of all seams that are contained in the bra of the invention are either on the outside or, if inside, are not at the extreme inside but are concealed from contact with the skin, avoiding any possibility of irritation. Both hardware and irritating elastic portions are avoided as much as possible, and if used, are positioned only at locations where they will not cause irritation, and protective cloth flaps are provided at the location of any hardware or elastic to further prevent irritation. The only hardware which may optionally be included is at the back side of the back strap, which may be formed in two sections connectable together adjustably with hook and eye type connections.

For maximum comfort and breast support, woven cotton is preferably used as the material for the entire bra. However, the under cups may be formed of a typical stretchable material, which may be cotton, for providing support while also helping facilitate body movement, but the top cups are preferably of non-stretchable cotton material.

Accordingly, in one embodiment of the invention, a bra for athletic activities comprises an under cup at each breast, extending from the bottom edge of the bra up to a line below the nipple position; a side panel at the outer end of each under cup, extending generally the same height as the under cup, for supporting the outer sides of the breasts; a top cup at each breast, above the under cup and connected to the under cup in a seam at said line, the top cup extending laterally above the side panel in continuous manner, to help distribute the tops of the breasts comfortably and naturally; a back strap extending from the outside ends of the side panels and top cups, for retaining the bra to the breasts; and a pair of shoulder straps, each extending from the tops of the top cups to a connection with the back strap, for supporting the bra on the shoulders; the bra having raw edges of seams on the outside for avoidance of irritation to the wearer; whereby adequate support and maximum comfort are provided the user during sporting activities.

It is therefore among the objects of the invention to provide an improved athletic bra which substantially eliminates all sources of irritation to the user while at the same time providing adequate support for the breasts, including avoidance of uncomfortable bounce and sway. These and other objects, advantages and features of the invention will be apparent from the following description of a preferred embodiment, taken in conjunction with the drawings.

DESCRIPTION OF THE DRAWINGS

FIG. 1 is a frontal elevational view showing the bra of the invention as it is worn on the body.

FIG. 2 is a side view showing the bra as it is worn.

FIG. 3 is a partial view of the bra showing the inside surface and details of construction.

FIG. 4 is a schematic sectional view taken along the line 4—4 of FIG. 3, illustrating seam construction.

FIG. 5 is a schematic sectional view taken along the line 5—5 of FIG. 3, also illustrating seam construction.

FIG. 6 is a schematic sectional view taken along the line 6—6 of FIG. 3, showing the connection of an elastic band to the bra.

FIG. 7 is a schematic sectional view taken along the line 7—7 of FIG. 3, showing details of construction at the ends of the back strap.

FIG. 8 is a sectional view taken along the line 8—8 of FIG. 3, showing edge construction at the top cups.

DESCRIPTION OF THE PREFERRED EMBODIMENT

In the drawings, FIGS. 1 and 2 show a bra 10 according to the invention, particularly constructed for athletic activities, as worn by a wearer 11. Included in the bra 10 are a pair of under cups 12, a pair of top cups 13 immediately above, a pair of shoulder straps 14 extending from the tops of the top cups 13 over the shoulders, and a back strap 16 which preferably comprises two sections as described below. As illustrated, the top cups 13 extend down to seams 17 below each apex or nipple 18, so that the seam 17 is always well below the nipple and irritation to the sensitive nipple area during jogging or other similar physical activity is avoided. Also in accordance with the present construction, each top cup 13 extends, on the end along the wearer's side, beyond the under cup 12 and over a side panel 19 which essentially comprises a contour extension for the under cup 12, ending generally at a stitch line 20 which is positioned generally under the arm. This differs from conventional bra construction, wherein the side panel, a strengthening and supporting element, typically extended through the height of both under cup and top cup, so that the top cup terminated at the side panel, generally coextensively with the under cup, tending to restrict the top portions of the breasts to a defined area. The side panel 19 of the present bra construction is adequate to assist the under cup 12 in supporting the natural breast curve at the outer sides of the breasts. The extended top cup allows an even and more natural distribution of the top portions of the breasts, to avoid unnatural confinement. Also in prior bra construction, the seam between the top cup and under cup usually was positioned about half way down, occurring generally in the nipple areas and tending to cause irritation during athletic activities.

FIGS. 3 through 8 illustrate a number of details of the present bra construction, with material layers shown separated and spatial relationships exaggerated and not to scale, for clarity. The seam 17 between under cup and top cup is of the sandwiched typed, as illustrated schematically in the sectional view of FIG. 4. Two layers 21 of material preferably form the under cup 12, while a single layer forms the top cup 13. The ends of the bottom cup layers 21 are folded under as indicated, so that the raw edges 30 of the seam are not exposed to the skin and also to add strength to the stitched connection, peferably made by inner and outer stitchings 22 and 23 as shown. Only the outer stitching 23 is exposed to either side.

FIG. 5 shows the construction of the side panels 19, which also comprise two layers 24 and 26 of material as indicated. The layers 24 and 26 are not at the outside of the bra in the seam on the right side of the panel 19 shown (see FIG. 3, which shows the inside of the bra), covered by a binding 25, and all raw edges 30 of seams which might otherwise cause irritation are concealed. The layer 24 is toward the outside of the bra, stitched with the layer 26 at equal length, and all raw edges 30 are concealed by the binding 25. Stitching is preferably as indicated.

FIG. 6 illustrates the connection of an elastic band 27 to the upper edge of the back strap 16 and of the top cup 13. It is positioned on the outside to avoid irritation, and the top edge of the bra material is folded under as illustrated, for maximum comfort at the inside surface. As indicated in FIG. 3, the elastic band 27 extends through most of the length of the back strap 16, in both sections, and along the top of the top cup 13 until it reaches the shoulder strap 14. A similar elastic band 28 is positioned along the lower edge of the bra, preferably being of one piece and continuous around the bra, interrupted only by the break 29 in the back strap which divides the back strap into two sections. The elastic band 28 is connected to the bra material similarly to the arrangement shown in FIG. 6.

FIG. 8 shows the manner in which the upper and inner edge 31 of each top cup is formed. This edge 31 should be non-elastic and of considerable strength, so an additional piece of material or "tape" strip 32 may be looped as indicated, on the outside, for reinforcement. The illustrated stitching construction conceals material edges 30 and provides for maximum comfort.

FIG. 7 illustrates the stitching and connection arrangement at the break 29 between the two sections of the back strap 16. Short portions of stretchable elastic material 33 may be included, and these may be stretchable material of the type sold under the trademark Spandex. These stretchable patches 33 provide for size adjustability. They are stitched directly to the strap material as indicated, and at their outer ends are connected pieces of non-stretchable fabric 34 and 36, which in turn are stitched to eyes 37 and hooks 38, respectively. Preferably at least two hooks and eyes are provided, as indicated in FIG. 3. Such hooks and eyes are the only hardware included in the bra 10, and even these may be eliminated if a one-piece back strap is provided. In the case of the one-piece back strap, the bra is slipped over the head when it is put on, and elastic portions such as the illustrated portions 33 provide for some expansion when the bra is being fitted onto the wearer.

If desired for size adjustability, additional pairs of eyes 37 may be provided, spaced a short distance along the end of the strap section from the illustrated eyes 37. In any event, if the hardware 37 and 38 is included, a flap of material 39 extends from the piece 34 at the left side of the back strap 16 for covering the hook and the eye, i.e. providing a shield between this hardware and the wearer's back. As illustrated, the flap 39 may take the form of a loop extending from the section 34 of material.

For additional protection, and particularly to prevent contact of the stretchable patches 33 with the wearer's skin, further flaps of material 41 are preferably provided. These are positioned directly against the wearer's back and afford protection from the elastic portions 33 and also from the hardware 37 and 38, to some extent, without reducing the adjustability of the back strap 16.

As seen in FIG. 3, the shoulder straps 14 may also include portions 42 of stretchable material, and these preferably are covered by slack pieces 43 of the soft strap material in order to prevent abrasion of the stretchable patch 42 against the skin. The stretchable patches 42 are located in the back portion of the shoulder straps 14, behind the tops of the shoulders, and avoid the need for shoulder strap adjustment hardware which many bras have included. The back ends 44 of the shoulder straps 14 are connected to the outside of the back strap sections 16, as illustrated in FIG. 3.

Soft but durable cotton is preferably used for the entire bra, including under cup 12, top cup 13 and straps 14 and 16. However, the under cups 12 may be made of a stretchable material typical of previous bra constructions.

The above described preferred embodiment provides an improved bra for athletic activities, one which substantially eliminates all irritation to the user during jogging and similar sporting movements, providing maximum comfort and support. Various other embodiments and variations to this preferred embodiment will be apparent to those skilled in the art and may be made without departing from the spirit and scope of the invention as defined by the following claims.

I claim:

1. A bra for athletic activities, comprising:

an under cup at each breast, extending from the bottom edge of the bra up to a line below the nipple position;

a side panel at the outer end of each under cup, extending generally the same height as the under cup, for supporting the outer sides of the breasts;

a top cup at each breast, above the under cup and connected to the under cup in a seam at said line, the top cup extending laterally above the side panel in continuous manner, to help distribute the tops of the breasts comfortably and naturally;

a back strap extending from the outside ends of the side panels and top cups, for retaining the bra to the breasts; and a pair of shoulder straps, each extending from the top of a top cup to a connection with the back strip, for supporting the bra on the shoulders;

the bra having the raw edges of all seams protected from contact with the wearer's skin, for avoidance of irritation to the wearer;

whereby adequate support and maximum comfort are provided the user during sporting activities.

2. The bra of claim 1 wherein the top cups are of cotton.

3. The bra of claim 1 wherein the under cups are of stretchable material.

4. The bra of claim 1 wherein the under cups and top cups are of cotton.

5. The bra of claim 1 wherein the shoulder straps include stretchable elastic portions for size versatility, positioned to be located on the wearer behind and below the tops of the shoulders.

6. The bra of claim 5, including protective cloth flaps adjacent to the stretchable elastic portions, secured to the shoulder straps on the under sides and positioned to shield the wearer from the elastic portions.

7. The bra of claim 1 wherein the back strap is in two sections, with releasable, adjustable connection means at its rearward ends for providing size adjustment.

8. The bra of claim 7 wherein the adjustable connection means comprises a hook and eye connection, with each of said two sections including a stretchable elastic portion adjacent to the connection means and a protective cloth flap on the inside of the strap, positioned to extend between the elastic and the wearer's skin.

9. The bra of claim 8, including a further protective cloth flap extending from the end of one of the straps, positioned to lie just inside the hook and eye connection when in use, for further protection of the wearer against irritation.

* * * * *

UNITED STATES PATENT AND TRADEMARK OFFICE

CERTIFICATE OF CORRECTION

PATENT NO. : 4,314,569

DATED : February 9, 1982

INVENTOR(S) : Joanne E. Speno

It is certified that error appears in the above-identified patent and that said Letters Patent are hereby corrected as shown below:

Page 1, Item [76] Inventor: "1977 Reliez Valley Rd., Lafayette, Calif. 94549" should read —P.O. Box 2190, San Francisco, Calif. 94126—.

Signed and Sealed this

*Eleventh* Day of *May 1982*

[SEAL]

*Attest:*

GERALD J. MOSSINGHOFF

*Attesting Officer*

*Commissioner of Patents and Trademarks*